US009644625B2

(12) United States Patent
Obayashi et al.

(10) Patent No.: US 9,644,625 B2
(45) Date of Patent: May 9, 2017

(54) COMPRESSOR

(75) Inventors: Masakazu Obayashi, Kariya (JP); Hajime Kurita, Kariya (JP); Yasushi Suzuki, Kariya (JP); Yoshio Kimoto, Kariya (JP); Masaki Ota, Kariya (JP); Nobuaki Hoshino, Kariya (JP); Yusuke Yamazaki, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 481 days.

(21) Appl. No.: 13/885,743

(22) PCT Filed: Nov. 28, 2011

(86) PCT No.: PCT/JP2011/077374
§ 371 (c)(1),
(2), (4) Date: May 16, 2013

(87) PCT Pub. No.: WO2012/077519
PCT Pub. Date: Jun. 14, 2012

(65) Prior Publication Data

US 2013/0236342 A1 Sep. 12, 2013

(30) Foreign Application Priority Data

Dec. 8, 2010 (JP) ..... 2010-273226
Oct. 12, 2011 (JP) ..... 2011-224527

(51) Int. Cl.
*F04B 53/10* (2006.01)
*F04B 27/10* (2006.01)
*F04B 39/10* (2006.01)

(52) U.S. Cl.
CPC ..... *F04B 53/10* (2013.01); *F04B 27/1036* (2013.01); *F04B 39/1073* (2013.01); *F04B 53/1037* (2013.01); *F04B 53/1085* (2013.01)

(58) Field of Classification Search
CPC .. F04B 27/1009; F04B 27/1036; F04B 39/10; F04B 39/1073; F04B 39/108;
(Continued)

(56) References Cited

U.S. PATENT DOCUMENTS 2,434,734 A 1/1948 Buschmann
2,908,287 A 10/1959 Augustin
(Continued)

FOREIGN PATENT DOCUMENTS

DE 4039786 6/1992
DE 102006016253 10/2007
(Continued)

OTHER PUBLICATIONS

Germany Office action, mail date is Mar. 25, 2015.
(Continued)

*Primary Examiner* — Theodore Stigell
*Assistant Examiner* — Chirag Jariwala
(74) *Attorney, Agent, or Firm* — Greenblum & Bernstein, P.L.C.

(57) ABSTRACT

A compressor has suction reed valves each of which includes a fixation portion fixed to the valve base plate, a basal portion that extends from the fixation portion and is separable from the plate, and a valve flap extending from the basal portion toward the distal end to selectively open and close the suction port. Each suction port has a shape elongated in the width direction, which is orthogonal to the longitudinal direction. The width of the basal portion is greater than that of the suction port. Each valve flap includes an opening-closing portion facing the corresponding suction port and stoppers, which project from the ends in the width direction. The side edges in the width direction are continuous from the stoppers to the basal portion to gradually
(Continued)

approach the suction port. The cylinder block has pairs of recessed retainers. The stoppers contact the retainers.

15 Claims, 14 Drawing Sheets

(58) Field of Classification Search
CPC .. F04B 53/10; F04B 53/1037; F04B 53/1085; F16K 15/14; F16K 15/16
USPC ..... 417/269, 565, 569, 570, 571; 137/852, 137/855, 856
See application file for complete search history.

(56) References Cited

U.S. PATENT DOCUMENTS

| | | | | |
|---|---|---|---|---|
| 3,751,005 | A | 8/1973 | Earley | |
| 4,749,340 | A * | 6/1988 | Ikeda | F04B 27/1009 137/514 |
| 5,884,665 | A * | 3/1999 | Thurston | F04B 39/1073 137/855 |
| 6,468,060 | B1 | 10/2002 | Dormer et al. | |
| 6,471,490 | B2 * | 10/2002 | Kimura | F04B 27/1009 137/856 |
| 7,004,734 | B2 * | 2/2006 | Izawa | F04B 27/1009 137/512.15 |
| 7,390,176 | B2 * | 6/2008 | MacBain | F04B 39/1073 137/512.15 |
| 2003/0010167 | A1 | 1/2003 | Bianchi | |
| 2003/0068245 | A1 | 4/2003 | MacBain et al. | |
| 2007/0221274 | A1 | 9/2007 | Andersen | |
| 2008/0277008 | A1 | 11/2008 | MacBain et al. | |

FOREIGN PATENT DOCUMENTS

| | | |
|---|---|---|
| JP | 3121585 | 10/2000 |
| JP | 2001-193650 | 7/2001 |
| JP | 2001-221161 | 8/2001 |
| JP | 2003-129959 | 5/2003 |
| JP | 2005-105975 | 4/2005 |
| JP | 2009-509076 | 3/2009 |
| WO | 01/63126 | 8/2001 |
| WO | 2008/047515 | 4/2008 |

OTHER PUBLICATIONS

Search report from Japan, mail date is Feb. 21, 2012.
International Preliminary Report on Patentability from Japan, dated Jun. 12, 2013.

* cited by examiner

COMPRESSOR

FIELD OF THE INVENTION

The present invention relates to a compressor.

BACKGROUND OF THE INVENTION

Patent Document 1 discloses a conventional compressor. The compressor includes a housing in which compression chambers for compression refrigerant and suction chambers for drawing refrigerant into the compression chambers. A circular valve base plate is located between the compression chambers and the suction chambers. The valve base plate has suction ports extending therethrough. Each suction port selectively connects a compression chamber with a corresponding suction chamber. Suction valves, each of which has a suction reed valve, are fixed to the valve base plate. Each suction port is selectively opened and closed by the corresponding suction reed valve. Each suction reed valve extends in a radial direction and is elastically deformable.

Each suction reed valve includes a fixation portion fixed to the valve base plate, a basal portion that extends from the fixation portion in the longitudinal direction and is separable from the valve base plate, and a valve flap that extends from the basal portion toward the distal end in the longitudinal direction to selectively open and close the suction port. The valve base plate has a fixation surface on the side facing the suction chambers. The fixation portions of the suction reed valves are fixed to the fixation surface.

Unlike a typical compressor, in which the suction ports are circular holes, the suction ports of the compressor according to Patent Document 1 are oblong holes, each of which has a substantially arcuate shape extending parallel with the circumferential edge of the valve base plate. That is, each suction port bulges toward the distal end in the longitudinal direction and extends in a direction perpendicular to the longitudinal direction.

Each valve flap has an opening-closing portion, which faces the suction port, a main stopper, which projects from the opening-closing portion toward the distal end, and a pair of side stoppers projecting sideways from both sides of the opening-closing portion in the width direction.

Each cylinder bore in the housing has three recessed retainers. Each of the main stopper and the side stoppers contacts one of the retainers.

When each valve flap opens the corresponding suction port in the above described conventional compressor, the main stopper first contacts the associated retainer, so that further displacement is restricted. Then, the side stoppers contact the associated retainers, and further displacement is restricted. As a result, the valve flap is held at a position for opening the suction port to allow refrigerant to pass through the suction port and be drawn into the compression chamber. At this time, the main stopper and the side stoppers of the compressor prevent the suction reed valve from receiving a significant torsional load, thereby preventing the suction reed valve from vibrating.

PRIOR ART DOCUMENT

Patent Document

Patent Document 1: Japanese Laid-Open Patent Publication No. 2001-193650

SUMMARY OF THE INVENTION

In general, compressors are desired to have a significantly reduced suction resistance to improve the compression efficiency. In this regard, in the above described conventional compressor, when each valve flap opens the corresponding suction port, refrigerant that flows through the suction port strikes the main stopper, which hinders inflow of the refrigerant into the suction chamber. It is therefore difficult to significantly reduce the suction resistance.

Accordingly, it is an objective of the present invention to provide a compressor that is capable of significantly reduce suction resistance.

To achieve the foregoing objective and in accordance with one aspect of the present invention, a compressor is provided that includes a housing, a compression chamber, a suction chamber, a valve base plate, a suction port, and a suction reed valve. The compression chamber is defined in the housing. Refrigerant is compressed in the compression chamber. The suction chamber is defined in the housing. The refrigerant is drawn into the compression chamber through the suction chamber. The valve base plate is located between the compression chamber and the suction chamber. The suction port is formed in the valve base plate to extend through the valve base plate. The suction port is capable of connecting the compression chamber and the suction chamber with each other. The suction reed valve selectively opens and closes the suction port. The suction reed valve has an elongated shape with a distal end and is elastically deformable. The suction reed valve includes a fixation portion fixed to the valve base plate, a basal portion that extends from the fixation portion in the longitudinal direction of the suction reed valve and is separable from the valve base plate, and a valve flap that extends from the basal portion toward the distal end in the longitudinal direction of the suction reed valve to selectively open and close the suction port. The valve base plate has a fixation surface that faces the compression chamber, wherein the fixation portion is fixed to the fixation surface. The suction port has a shape elongated in a width direction, which is orthogonal to the longitudinal direction of the suction reed valve. The width of the basal portion is set to be greater than the measurement of the suction port in the width direction. The valve flap includes an opening-closing portion that faces the suction port, a pair of stoppers projecting from the opening-closing portion at both ends in the width direction of the suction port, and a pair of side edges that extends continuously from the stoppers to the basal portion to gradually approach the suction port. The housing has a pair of retainers, wherein each stopper contacts one of the retainers.

According to the above configuration, the suction port has a shape elongated in the width direction, which is orthogonal to the longitudinal direction. Specific examples include elliptic suction ports and oblong suction ports. This allows the suction area of the suction port to be easily increased compared to a circular suction port in a typical compressor. Thus, refrigerant smoothly flows through the suction port.

When the opening area of a suction port that has a shape elongated in the width direction is equal to that of a circular suction port of a typical compressor, the position of the suction port can be shifted toward the distal end in the longitudinal direction compared to the circular suction port. This adds to flexibility in designing the structures at the radially inner portion, which is located opposite to the distal end in the longitudinal direction, for example, the positions and shapes of discharge reed valves and discharge ports. In this case, the valve flap, which selectively opens and closes the suction port, is also shifted toward the distal end in the longitudinal direction. This allows the length of the base portion, or in other words, the arm length between the valve flap and the fixation portion, to be increased. Thus, compared to a conventional compressor of the same size, the valve flap can be displaced by a greater amount for a given flexure of the suction reed valve. Therefore, the opening-closing portion quickly closes the suction port when the pressure in the compression chamber surpasses the pressure in the suction chamber. In contrast, the opening-closing portion quickly opens the suction port when the pressure in the compression chamber falls below the pressure in the suction chamber.

As a result, refrigerant smoothly flows through the suction port.

In a case of a circular suction port, a valve flap, which selectively opens and closes the suction port, has an edge at the distal end in the longitudinal direction, which edge has an arcuate shape and tends to conform to the circumferential edge of a compression chamber. Therefore, a space through which refrigerant can flow is unlikely to be formed between the edge of the valve flap at the distal end and the circumferential edge of the compression chamber. In this respect, in a case of a suction port having a shape elongated in the width direction, which is orthogonal to the longitudinal direction, the valve flap, which selectively opens and closes the suction port, has an edge at the distal end in the longitudinal direction that extends in a straight line and is unlikely to conform to the circumferential edge of the compression chamber. Therefore, a large space through which refrigerant can flow can be formed between the edge of the valve flap at the distal end and the circumferential edge of the compression chamber. As a result, the formed space allows refrigerant that has passed through the suction port to be readily drawn into the compression chamber.

In the case of a circular hole, if high pressure liquid compression occurs, the valve flap that selectively opens and closes the suction port bulges at a center. In contrast, in a case of a suction port having a shape elongated in the width direction, which is orthogonal to the longitudinal direction, the valve flap, which selectively opens and closes the suction port, can be shortened in the longitudinal direction, so that deformation of the valve flap is suppressed.

In the compressor, the width of the basal portion is set to be larger than the length of the suction port in the width direction. Therefore, the opening-closing portion, which faces the suction port, can be reliably supported.

Further, in the compressor, when the valve flap starts opening the suction port, the stoppers, which extend laterally from both sides in the width direction, each contact the corresponding retainer. This restricts displacement of the valve flap, so that the valve flap is held at a position for opening the suction port. Unlike the main stopper of the above described conventional technique, the valve flap does not have a stopper that protrudes from the opening-closing portion toward the distal end in the longitudinal direction. Therefore, refrigerant that has passed through the suction port is not blocked by a stopper when passing through the space between the edge of the valve flap at the distal end and the circumferential edge of the compression chamber. Further, since the side edges extend continuously from the stoppers to the basal portion to gradually approach the suction port, a large space through which refrigerant flows is formed between each of the side edges and the circumferential edge of the compression chamber. Refrigerant that has passed through the suction port is therefore unlikely to be blocked by the side edges. That is, the refrigerant that has passed through the suction port is split in three directions in the vicinity of the opening-closing portion, or toward the distal end in the longitudinal direction and toward the side edges, before being conducted into the compression chamber. This promotes the flow of refrigerant into the compression chamber.

In this manner, the compressor of the present invention significantly reduces the suction resistance.

The valve base plate preferably includes a loop-shaped recessed groove that is formed in the fixation surface and encompasses the suction port and a sealing surface formed inside the region encompassed by the recessed groove. The sealing surface is flush with the fixation surface and is contactable in a loop area with the opening-closing portion in a region about the suction port. The recessed groove may either entirely encompass the suction port or partly encompass the suction port.

In accordance with the above described configuration, the recessed groove is formed to form a sealing surface. The recessed groove separates the opening-closing portion from the bottom surface of the recessed groove, thereby allowing the opening-closing portion to be easily opened by a pressure difference. The sealing surface contacts, in a loop area, the opening-closing portion when the valve is closed, which prevents refrigerant from leaking from the compression chamber to the suction chamber via the suction port.

The side edges are preferably separated from the bottom surface of the recessed groove. If the side edges separate from the bottom surface of the recessed groove, the opening-closing portion is more easily opened by a pressure difference.

The stoppers are preferably separated from the bottom surface of the recessed groove. If the stopper separates from the bottom surface of the recessed groove, the opening-closing portion is more easily opened by a pressure difference. Also, the compressor is unlikely to have suction pulsation.

The valve base plate preferably has a support surface that is flush with the fixation surface and contactable with a central region of the opening-closing portion.

In this case, when the suction reed valve is closed and the central region of the opening-closing portion acts to move toward the valve base plate due to an inertial force and a pressure difference, the support surface, which is flush with the fixation surface, is formed on the valve base plate and the support surface contacts the central region of the opening-closing portion. Thus, the central region of the opening-closing portion is not significantly flexed into the suction port. Therefore, the valve flap becomes less prone to fatigue failure. Also, the compressor is unlikely to have suction pulsation. The central region of the opening-closing portion refers to an area inside the part with which the sealing surface of the valve base plate makes contact.

The valve base plate preferably has an extension portion that extends in a manner dividing the suction port in two in the width direction, and the support surface is preferably formed on the extension portion.

In this case, the support surface is easily formed on the valve base plate. The extension portion need not necessarily divide the suction port in two as long as it extends in a manner dividing the suction port in two. The direction in which the extension portion extends is not limited to the direction toward the center of the suction port, but may be shifted to any of the edges of the suction port.

The extension portion preferably extends in the longitudinal direction of the suction reed valve only from a side corresponding to the basal portion toward a side corresponding to the distal end of the suction reed valve. In this case, the instant the suction reed valve separates from the valve base plate at the basal portion and the valve flap opens the suction port, refrigerant is readily drawn into the compression chamber through the space at the distal end of the suction port in the longitudinal direction without being blocked by the extension portion. This reduces the suction resistance, thereby more reliably reducing power loss.

A communicating groove is preferably recessed in a surface of the extension portion that faces the valve flap, and the communication surface preferably communicates with the suction port when the suction port is closed. In this case, a force causing tight contact does not easily act on the back surface of the valve flap. Instead, the pressure in the suction port acts on the back surface of the valve flap, which further reduces the suction resistance. Power loss is further reliably reduced.

The suction port is preferably formed by punching, and the recessed groove and the communicating groove are formed by crushing. If the valve base plate is formed by punching and crushing a workpiece using a punch, the manufacture costs are reduced compared to a case in which cutting is performed. The punch for forming the suction port through punching and the punch for forming the recessed groove and the communicating groove through crushing are preferably moved toward the workpiece from opposite directions.

A recess is preferably recessed in a surface of the extension portion that faces the valve flap, and the recess is disconnected from the suction port when the suction port is closed. In this case, a force causing tight contact does not easily act on the back surface of the valve flap, and the suction resistance can be further reduced. Power loss is therefore further reliably reduced.

The suction port is preferably formed by punching, and the recessed groove and the recess are formed by crushing. If the valve base plate is formed by punching and crushing a workpiece using a punch, the manufacture costs are reduced compared to a case in which cutting is performed. The punch for forming the suction port through punching and the punch for forming the recessed groove and the recess through crushing are preferably moved toward the workpiece from the opposite directions.

The stoppers are each preferably formed to make surface contact with the corresponding retainer. In this case, the stopper and the retainer are unlikely to be damaged and therefore have an improved durability.

The depths of the retainers are preferably different from each other.

In a typical compressor, an oil film sealing located between i) the basal portion and the valve flap and ii) the valve base plate applies a force causing tight contact therebetween. Therefore, when the valve flap starts opening the suction port, a delay in the opening occurs until the pressure difference between the compression chamber and the suction chamber exceeds the tight contact causing force. Thereafter, the basal portion and the valve flap are urged by the great pressure difference and abruptly start separating from the valve base plate. The abruptly displaced basal portion and valve flap are vibrated by a large amplitude due to the reaction. As a result, suction pulsation is easily caused in the typical compressor.

In this respect, since the retainers have different depths, when the valve flap starts opening the suction port, one of the stoppers contacts the corresponding retainer to restrict the displacement of the stopper. Then, the other stopper contacts the corresponding retainer to restrict displacement. As a result, the valve flap is twisted about the distal end and is held in a state inclined relative to the valve base plate to open the suction port. At this time, the contact between one of the stoppers and the corresponding retainer prevents the basal portion and the valve flap from being abruptly separated from the valve base plate. That is, the contact prevents abrupt movement of the basal portion and the valve flap. Subsequently, when the basal portion and the valve flap are further separated from the valve base plate, frictional resistance is generated between one of the stoppers and the corresponding retainer, which contact each other. This effectively restricts vibration of the basal portion and the valve flap. Accordingly, the amplitude of the basal portion and the valve flap is reduced. As a result, the compressor reduces the suction pulsation.

Effects of the Invention

The compressor of the present invention significantly reduces suction resistance.

DETAILED DESCRIPTION OF THE PREFERRED EMBODIMENTS

Figure 1:
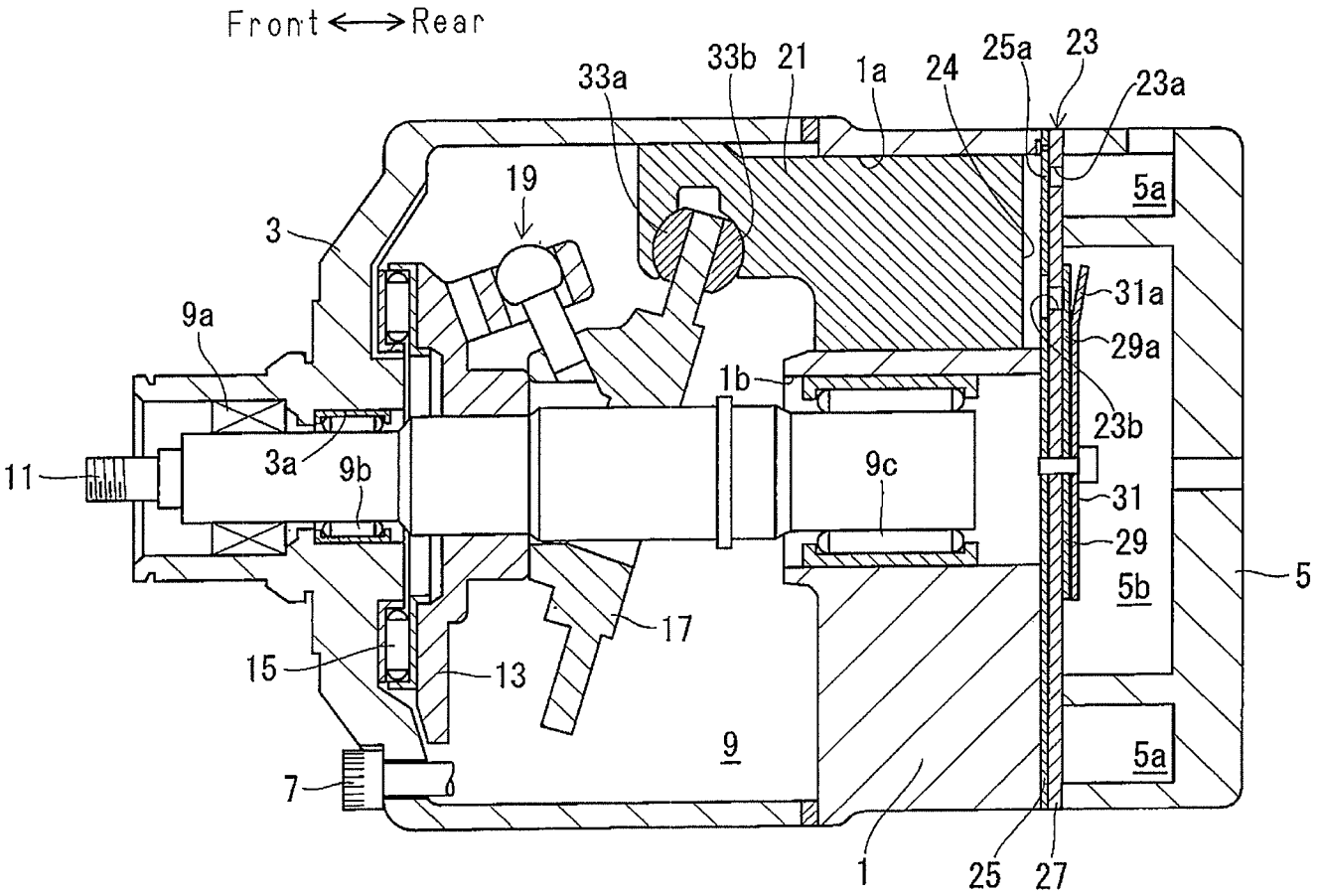
FIG. 1 is a longitudinal cross-sectional view illustrating a compressor according to a first embodiment of the present invention.

Compressors according to first to tenth embodiments of the present invention will now be described with reference to the drawings. In FIG. 1, the left side is defined as a front side, and the right side is defined as a rear side. The front-rear direction is defined, accordingly. The front-rear directions shown in the other drawings correspond to that in FIG. 1.

First Embodiment

A compressor according to the first embodiment is a swash plate type variable displacement compressor. As shown in FIG. 1, the compressor has a cylinder block 1 and a plurality of cylinder bores 1*a* formed in the cylinder block 1. The cylinder bores 1*a* are arranged about the center axis of the cylinder block 1 and spaced apart at equal angular intervals. The cylinder block 1 is held between a front housing member 3, which is located in front, and a rear housing member 5, which is located behind. The cylinder block 1, the front housing member 3, and the rear housing member 5 are fastened in this state by bolts 7. The cylinder block 1 and the front housing member 3 define a crank chamber 9 inside. A suction chamber 5*a* and a discharge chamber 5*b* are defined in the rear housing member 5.

A shaft hole 3*a* is formed in the front housing member 3. Another shaft hole 1*b* is formed in the cylinder block 1. The shaft holes 3*a*, 1*b* rotationally support a drive shaft 11 via a shaft sealing device 9*a* and radial bearings 9*b*, 9*c*. A pulley and an electromagnetic clutch (neither is shown) are attached to the drive shaft 11. A belt is hooked around the pulley or the electromagnetic clutch. The belt is driven by a drive source such as a vehicle engine.

A lug plate 13 is press fitted to the drive shaft 11 and located in the crank chamber 9. A thrust bearing 15 is located between the lug plate 13 and the front housing member 3. A swash plate 17 is fitted about the drive shaft 11. The lug plate 13 and the swash plate 17 are coupled to each other by a link mechanism 19, which supports the swash plate 17. The link mechanism 19 is capable of changing the inclination angle of the swash plate 17.

A piston 21 is reciprocally housed in each cylinder bore 1*a*. A valve unit 23 is located between the cylinder block 1 and the rear housing member 5. The valve unit 23 includes a suction valve plate 25, a valve base plate 27, a discharge valve plate 29, and a retainer plate 31. The valve base plate 27 has discharge ports 23*b* and suction ports 23*a*, which extend through the valve base plate 27. The cylinder block 1, the front housing member 3, the rear housing member 5, and the valve unit 23 form one example of a housing according to the present invention.

Figure 2:
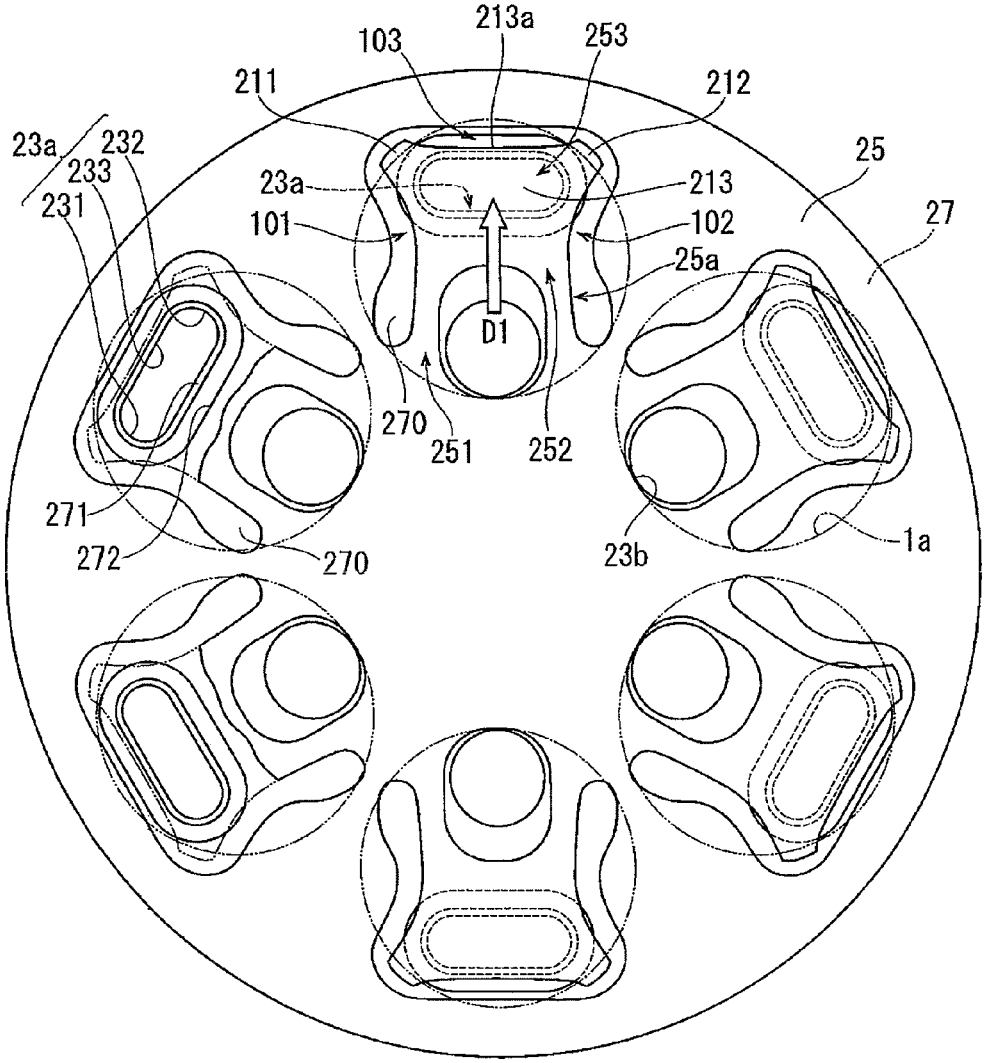
FIG. 2 is a plan view of the compressor of the first embodiment, illustrating a valve base plate and a suction valve plate in which suction reed valves are formed.

In the first embodiment, the suction valve plate 25 is circular and thin plate, which is elastically deformable as shown in FIGS. 2 and 3. In a normal state, a front surface 25*f* and a back surface 25*r* of the suction valve plate 25 are parallel with each other. In FIG. 2, the front of the sheet of the drawing matches with the front side of the compressor, and the back of the sheet matches with the rear side of the compressor. The cylinder bores 1*a* are located at the front of the sheet of the drawing with respect to the suction valve plate 25 and are therefore represented by broken lines in which a long dash alternates with a pair of short dashes. The valve base plate 27 is located at the back of the sheet of the drawing of FIG. 2 with respect to the suction valve plate 25. The suction valve plate 25 has a plurality of elongated and extending pieces, which extend in radial direction from the center. The extending pieces are formed by removing surrounding parts in the suction valve plate 25. The elongated extending pieces are suction reed valves 25*a*. The radial direction of the suction valve plate 25, that is, the direction in which each suction reed valve 25*a* extends is referred to as a longitudinal direction, and the end in the direction from the center toward the outside is referred to a distal side D1 of the longitudinal direction.

As shown in FIG. 1, a pair of front and rear shoes 33*a*, 33*b* is provided between the swash plate 17 and each piston 21. Wobbling motion of the swash plate 17 is converted into reciprocation of the pistons 21 by the shoes 33*a*, 33*b*. The cylinder bores 1*a*, the pistons 21, and the valve unit 23 define compression chambers 24.

Although not illustrated, the crank chamber 9 and the suction chamber 5*a* are connected to each other via a bleed passage. The crank chamber 9 and the discharge chamber 5*b* are connected to each other via a supply passage. A non-illustrated displacement control valve is located in the supply passage. The displacement control valve is configured to change the opening degree of the supply passage in accordance with suction pressure. Although not illustrated, the discharge chamber 5*b* of the compressor is connected to a condenser, which is in turn connected to an evaporator via an expansion valve. The evaporator is connected to the suction chamber 5*a* of the compressor. The compressor, the condenser, the expansion valve, and the evaporator are mounted on the vehicle to form an air conditioner, which air-conditions the passenger compartment.

The valve base plate 27 has the discharge ports 23*b*, each of which connects a compression chamber 24 with the discharge chamber 5*b*. The discharge valve plate 29 has discharge reed valves 29*a*, which selectively open and close the discharge ports 23*b*. The retainer plate 31 has retainers 31*a*, which limits the lift of the discharge reed valves 29*a*.

The valve base plate 27 also has the suction ports 23*a*, which connect the suction chamber 5*a* with the compression chambers 24. As shown in FIG. 2, each suction port 23*a* is shifted toward the distal side D1 in relation to the center of the corresponding cylinder bore 1*a*.

Figure 3A:
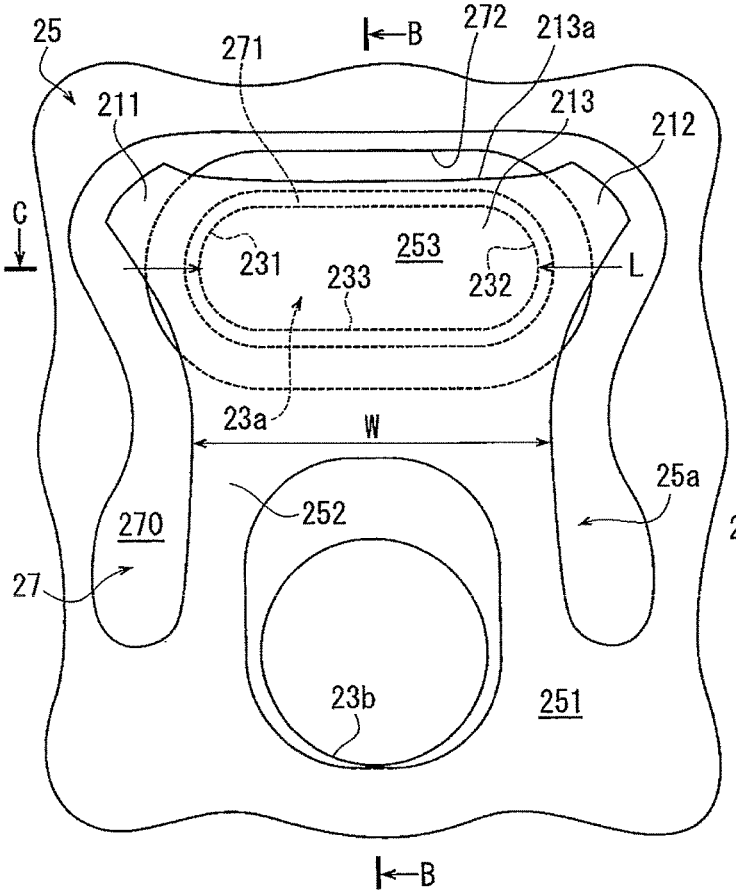
FIG. 3A is an enlarged plan view of the compressor of the first embodiment, illustrating the valve base plate and a suction reed valve.

As shown in FIG. 3A, each suction port 23*a* has a straight section 233, which extends in a width direction, which is orthogonal to the longitudinal direction, and arcuate sections 231, 232, which are located at the ends of the straight section 233. In other words, the suction port 23*a* has an oblong shape that is formed by combining a rectangular straight section 233, which is extended in the width direction, and the semicircular arcuate sections 231, 232 at the ends of the straight section 233.

Figure 3B:
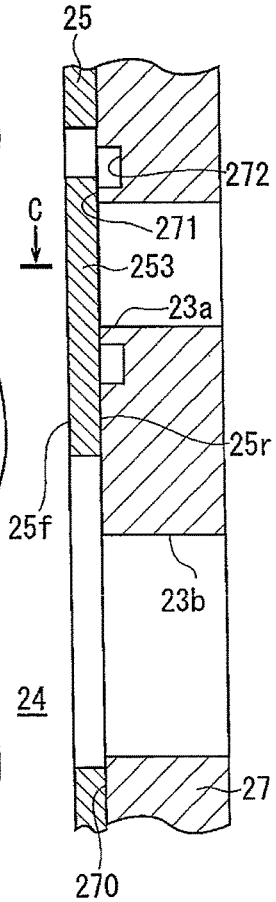
FIG. 3B is a cross-sectional view taken along line B-B in FIG. 3A.
Figure 3C:
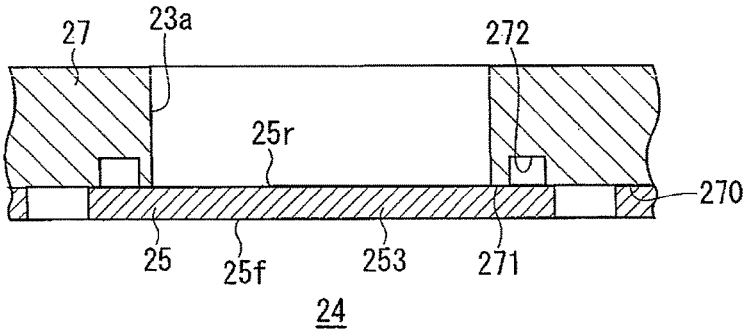
FIG. 3C is a cross-sectional view taken along line C-C in FIG. 3A.

As shown FIGS. 3B and 3C, the valve base plate 27 has a fixation surface 270, which faces the compression chambers 24. Recessed grooves 272 are formed in the fixation surface 270. Each recessed groove 272 has a looped and oblong shape to surround one of the suction ports 23*a*. Each recessed groove 272 surrounds one of the suction ports 23*a*. In the present embodiment, each recessed groove 272 entirely encompasses a suction port 23*a*, but may only partly encompass the suction port 23*a*. That is, without entirely encompassing the suction port 23*a*, the recessed groove 272 may be formed to be partly discontinuous. On the fixation surface 270, a flat sealing surface (also referred to as an eyeglass-shaped portion) 271 is formed in a loop area between each suction port 23*a* and the corresponding recessed groove 272. Lubricating oil is drawn into each recessed groove 272. When a valve flap 253, which will be discussed below, closes the suction port 23*a*, the lubricating oil in the recessed groove 272 closely contacts the back surface 25*r* of the valve flap 253 while surrounding the sealing surface 271. This allows the valve flap 253 to reliably close the suction port 23*a*.

Figure 5:
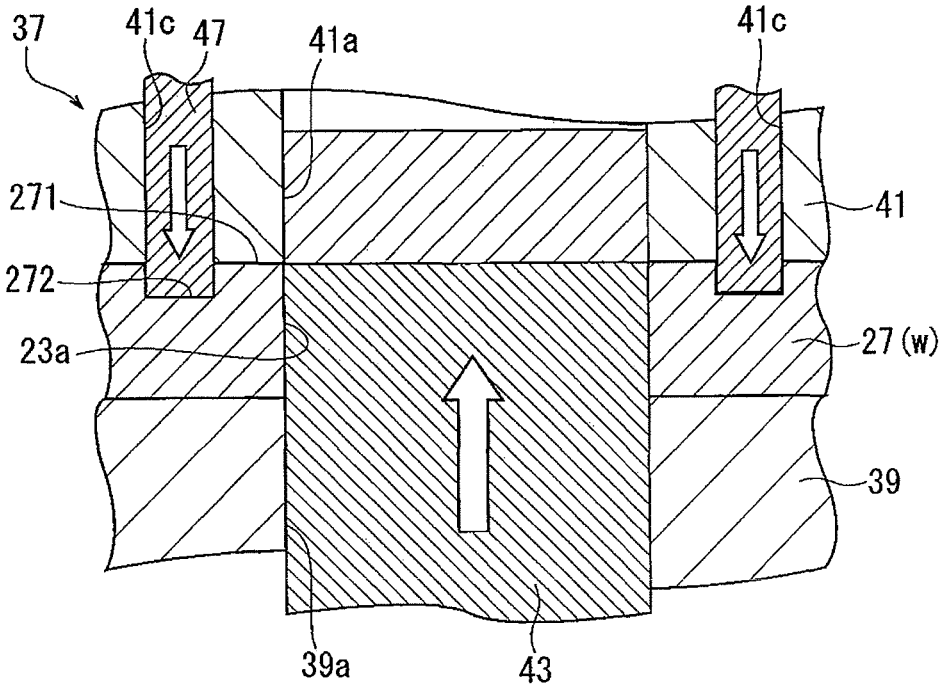
FIG. 5 is a schematic cross-sectional view of the compressor of the first embodiment, illustrating a manufacturing step of the valve base plate.

The valve base plate 27 as described above is formed using a die 37 shown in FIG. 5. The die 37 has a lower die portion 39 and an upper die portion 41. A workpiece w, from which the valve base plate 27 is formed, is clamped between the lower die portion 39 and the upper die portion 41. The lower die portion 39 has punch holes 39*a* at positions corresponding to the suction ports 23*a*. The punch holes 39*a* extend through the lower die portion 39 in the vertical direction. A punch 43 is received in each punch hole 39*a* to be movable in the vertical direction.

The upper die portion 41 has ejection holes 41*a*, which correspond to the punch holes 39*a* and extend through the upper die portion 41 in the vertical direction. The upper die portion 41 also has punch holes 41*c* at positions corresponding to the recessed grooves 272. The punch holes 41*c* extend through the upper die portion 41 in the vertical direction. A punch 47 is received in each punch hole 41*c* to be movable in the vertical direction.

To form the valve base plate 27 from the workpiece w, the workpiece w is placed between the lower die portion 39 and the upper die portion 41. Then, the punches 43 are raised from below and the punches 47 are lowered from above. As a result, the suction ports 23*a* are formed through punching and the recessed grooves 272 are formed through crushing. Through the formation of the recessed grooves 272, the sealing surfaces 271 are formed. Afterwards, surface polishing is performed to complete the valve base plate 27. This reduces the manufacturing costs compared to a cutting process.

Figure 4:
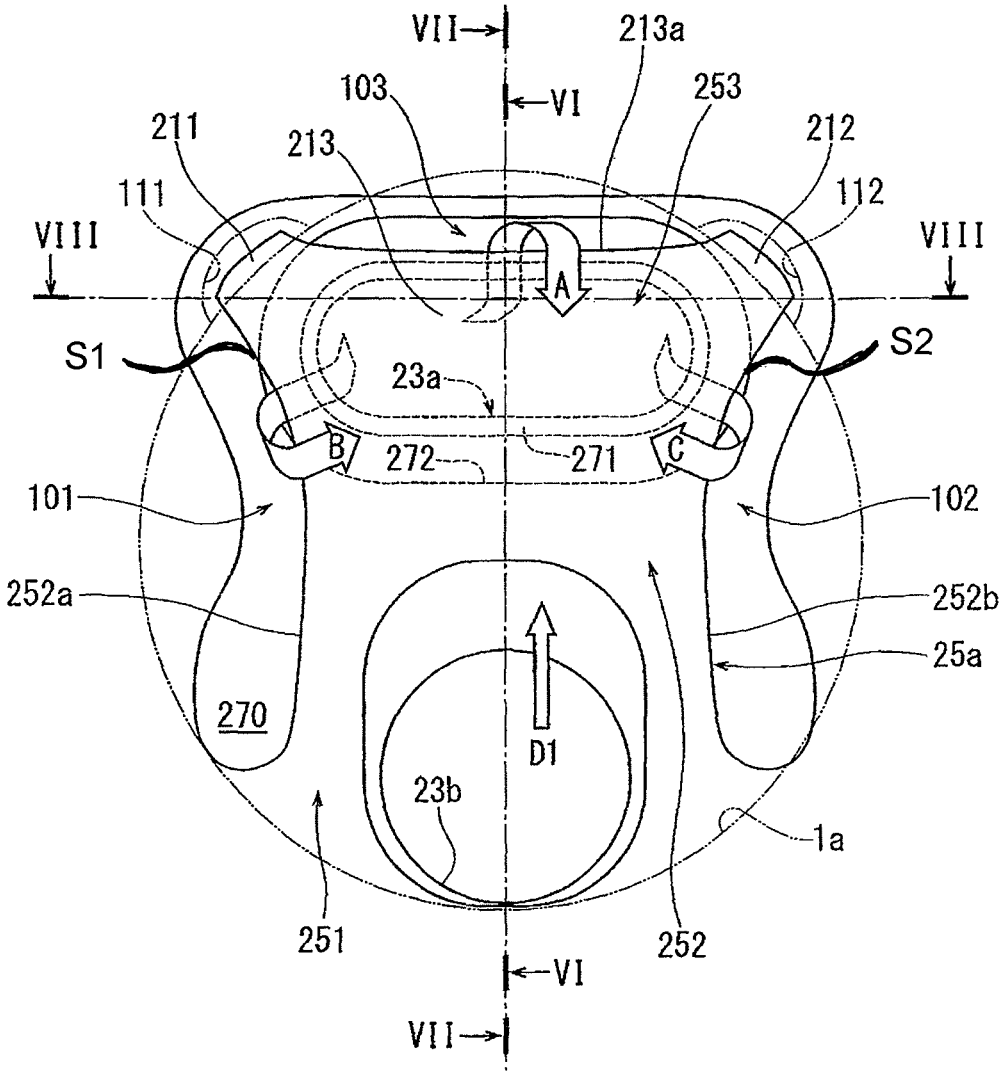
FIG. 4 is an enlarged plan view of the compressor of the first embodiment, illustrating a part of FIG. 2.

As shown in FIGS. 3 and 4, each suction reed valve 25*a* includes a fixation portion 251, which is fixed to the fixation surface 270 of the valve base plate 27, a basal portion 252, which extends from the fixation portion 251 in the longitudinal direction and is separable from the fixation surface 270, and a valve flap 253, which extends from the basal portion 252 toward the distal side D1 and selectively opens and closes the corresponding suction port 23*a*.

Each valve flap 253 includes an opening-closing portion 213, which faces a suction port 23*a*. The opening-closing portion 213 corresponds to the position of the suction ports 23*a* and is shifted toward the distal side D1 relative to the center of the corresponding cylinder bore 1*a*. Thus, the length of the basal portion 252, in other words, the arm length between the valve flap 253 and the fixation portion 251 is relatively long. This increases displacement of the valve flap 253 in relation to a given flexure of the suction reed valve 25*a*. The width W of the basal portion 252 is set to be longer than the length L of the suction port 23*a* in the width direction. This allows the basal portion 252 to reliably support the opening-closing portion 213.

Each valve flap 253 includes a pair of stoppers 211, 212. The stoppers 211, 212 project toward the distal side D1 from the opening-closing portion 213 at both ends in the width direction. Each of the stoppers 211, 212 extends beyond the area of the cylinder bore 1*a* by one to several millimeters. The distal edge 213*a* of the opening-closing portion 213 extends straightly in the width direction between the stoppers 211 and 212. The distal edge 213*a* is located within the distal part of the recessed groove 272.

As shown in FIG. 4, the cylinder block 1 includes recessed retainers 111, 112. The stoppers 211 and 212 contact the retainers 111, 112, respectively. The outermost side S1 and S2 of each of the pair of stoppers 211 and 212 entirely diverge from each other in a direction towards a free end of the valve flap 253.

Figure 6:
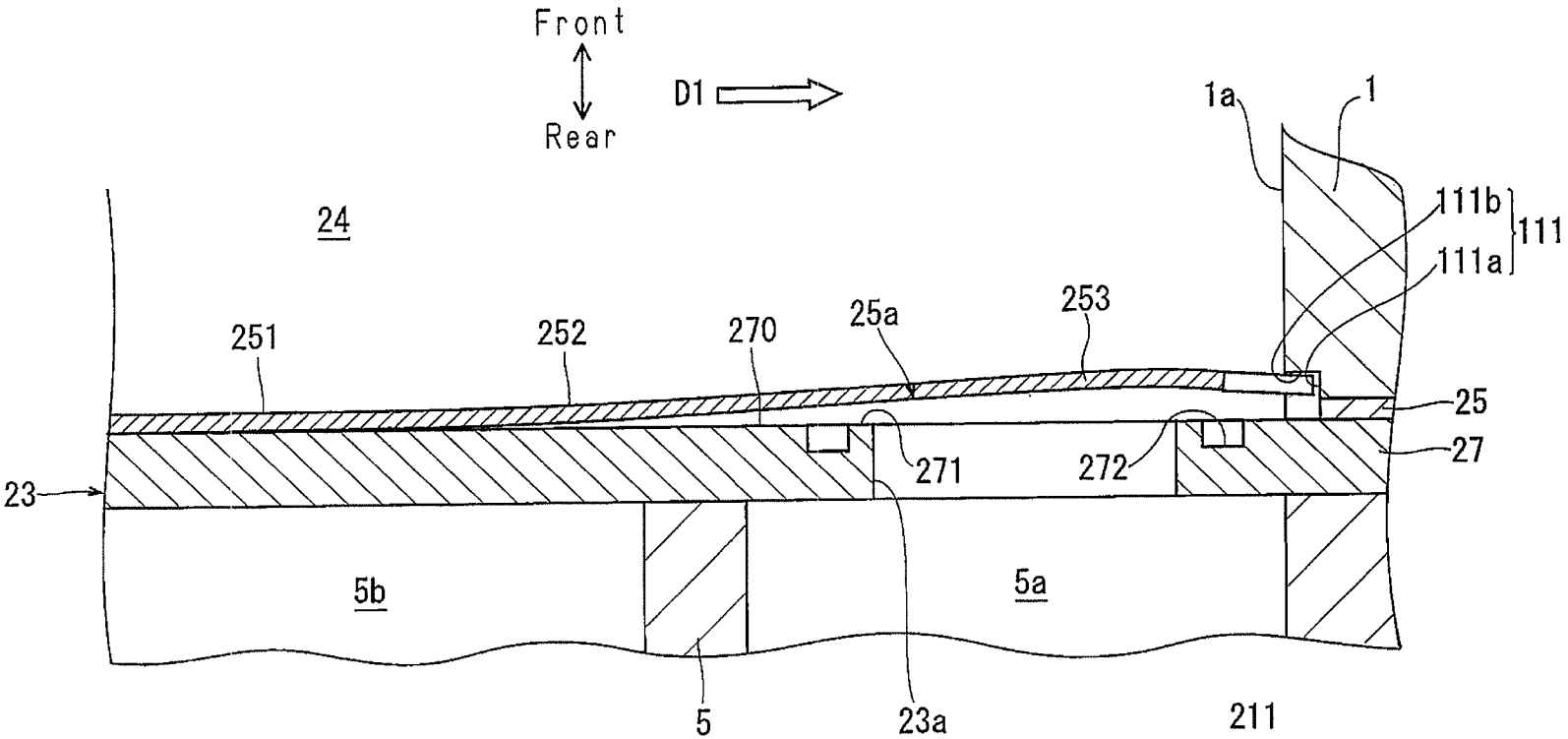
FIG. 6 is an enlarged cross-sectional view taken along line VI-VI of FIG. 4 of the compressor according to the first embodiment, illustrating a state in which the suction reed valve opens the suction port.
Figure 8:
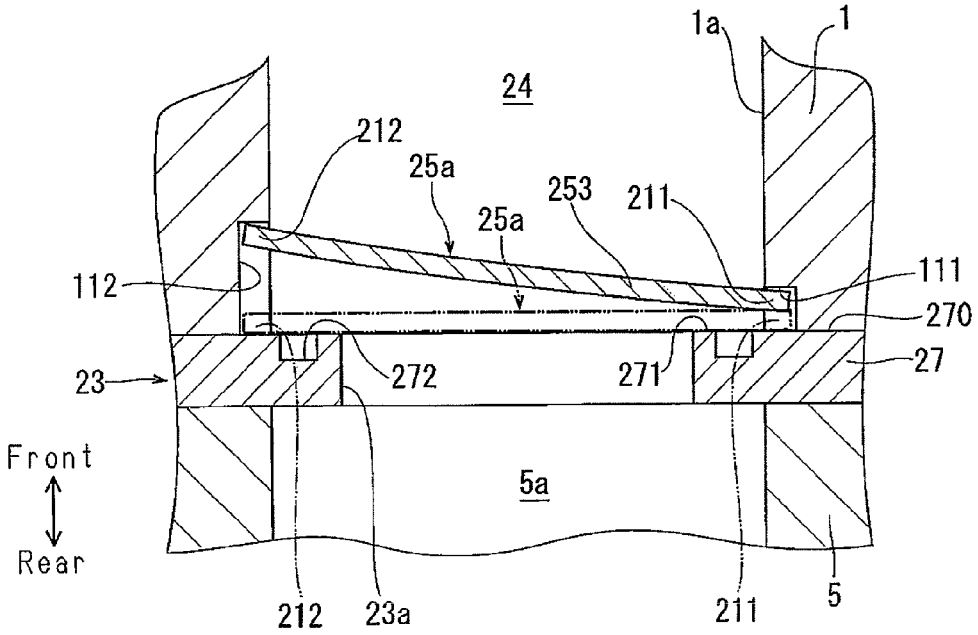
FIG. 8 is an enlarged cross-sectional view taken along line VIII-VIII of FIG. 4 of the compressor according to the first embodiment, illustrating a state in which the suction reed valve opens the suction port.

As shown in FIGS. 6 and 8, each retainer 111 includes a recess 111*a* at the rear end of the cylinder block 1. The recess 111*a* has a contact surface 111*b*. When the valve flap 253 closes the suction port 23*a*, the stopper 211 contacts the fixation surface 270 as represented by broken lines in which a long dash alternates with a pair of short dashes in FIG. 8. On the other hand, when the valve flap 253 opens the suction port 23*a*, the stopper 211 separates from the fixation surface 270 and is moved in the recess 111*a* to contact the contact surface 111*b* as represented by solid lines in FIG. 8. That is, the stroke of the stopper 211 is equal to the depth of the recess 111*a*.

Figure 7:
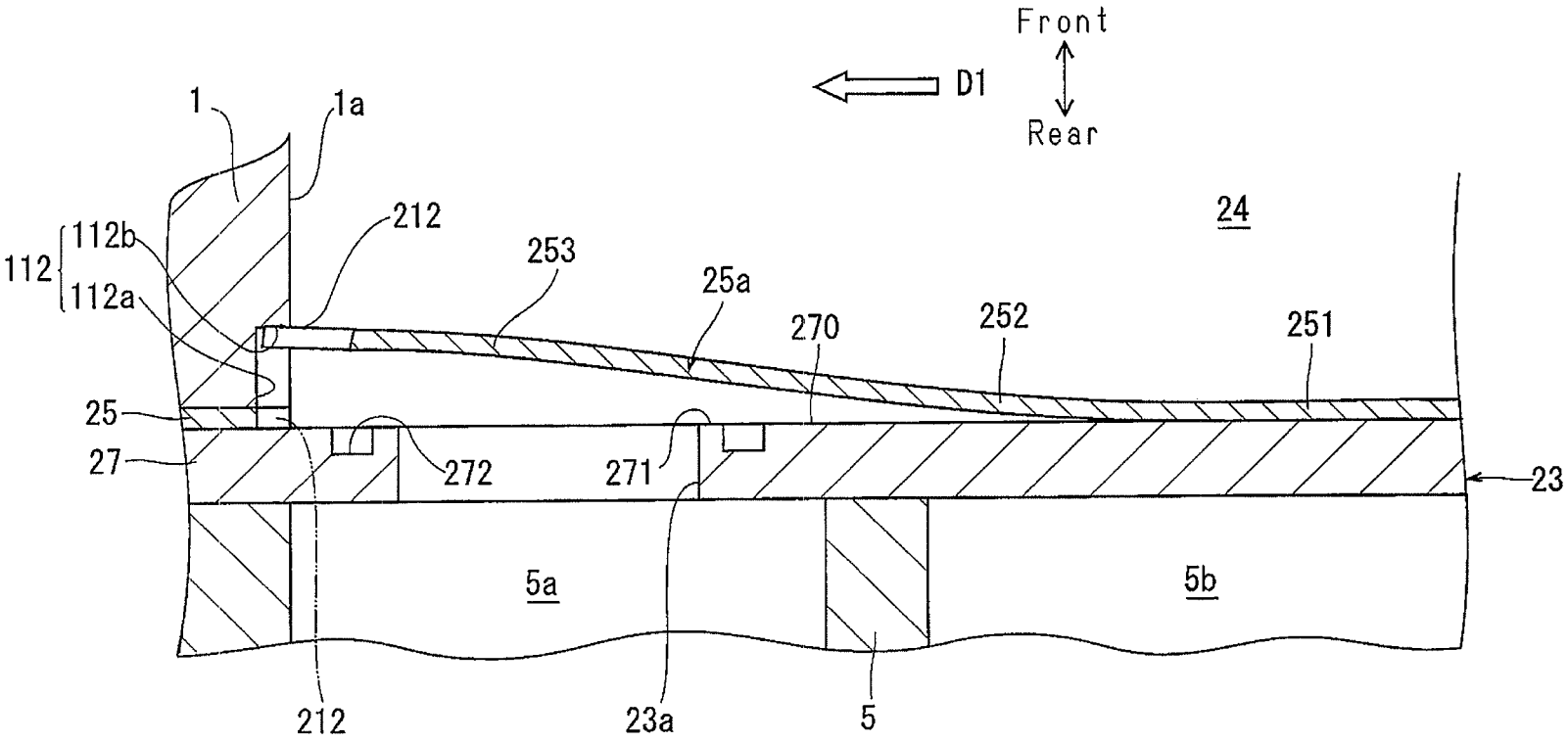
FIG. 7 is an enlarged cross-sectional view taken along line VII-VII of FIG. 4 of the compressor according to the first embodiment, illustrating a state in which the suction reed valve opens the suction port.

As shown in FIGS. 7 and 8, each retainer 112 includes a recess 112*a* at the rear end of the cylinder block 1. The recess 112*a* has a contact surface 112*b*. The recess 112*a* is formed to be deeper than the recess 111*a*. When the valve flap 253 closes the suction port 23*a*, the stopper 212 contacts the fixation surface 270 as represented by broken lines in which a long dash alternates with a pair of short dashes in FIG. 8. On the other hand, when the valve flap 253 opens the suction port 23*a*, the stopper 212 separates from the fixation surface 270 and is moved in the recess 112*a* to contact the contact surface 112*b* as represented by solid lines in FIG. 8. That is, the stroke of the stopper 212 is equal to the depth of the recess 112*a*.

As shown in FIGS. 3 and 4, a space 103 is formed between the distal edge 213*a* of the opening-closing portion 213 and the cylinder bore 1*a*. The space 103 is located on the distal side D1 with respect to the straight section 233 and extends parallel with the straight section 233.

Each basal portion 252 of the suction valve plate 25 has a side edge 252*a*. The side edge 252*a* is located on one side in the width direction of the basal portion 252 and extends toward the distal side D1 to be connected to the stopper 211. A space 101 is formed between the side edge 252*a* and the cylinder bore 1*a*. Each basal portion 252 of the suction valve plate 25 also has side edge 252*b*. The side edge 252*b* is located on the other side of the basal portion 252 and extends toward the distal side D1 to be connected to the stopper 212. A space 102 is formed between the side edge 252*b* and the cylinder bore 1*a*. The side edges 252*a*, 252*b* are continuous from the stoppers 211, 212 to the basal portion 252 and curved to gradually approach the arcuate sections 231, 232.

As shown in FIG. 4, when the valve flap 253 opens the suction port 23*a*, the refrigerant that has passed through the suction port 23*a* flows into the corresponding compression chamber 24 mainly via paths in three directions, which are a path through the space 103 between the distal edge 213*a* and the cylinder bore 1*a* (see arrow A), a path through the space 101 between the side edge 252*a* and the cylinder bore 1*a* (see arrow B), and a path through the space 102 between the side edge 252*b* and the cylinder bore 1*a*.

According to the compressor as described above, when the drive shaft 11 rotates, the lug plate 13 and the swash plate 17 are rotated in synchronization with the drive shaft 11. Then, each piston 21 reciprocates within the corresponding cylinder bore 1*a* by a stroke that corresponds to the inclination angle of the swash plate 17. Thus, refrigerant in the suction chamber 5*a* is drawn into the compression chambers 24 to be compressed and is then discharged to the discharge chamber 5*b*. As a result, the refrigerant circulates through the compressor, the condenser, the expansion valve, and the evaporator to air-condition the passenger compartment.

According to the compressor of the first embodiment, the suction ports 23*a* each have an oblong shape that extends in the width direction. Thus, compared to a circular suction port in a typical compressor, the suction area can be easily enlarged to allow refrigerant to smoothly flow through the suction port 23*a*.

Further, if the opening area of the suction port 23*a* is equal to the opening area of a circular suction port, the position of the suction port 23*a* can be shifted toward the distal side D1. This adds to flexibility of the design of the section on the side opposite to the distal side D1, for example, the positions and shapes of the discharge reed valve 29*a* and the discharge port 23*b*. In this case, the valve flap 253, which selectively opens and closes the suction port 23*a*, is also shifted toward the distal side D1, so that the length of the basal portion 252, or the arm length between the valve flap 253 and the fixation portion 251 is extended. Thus, compared to a conventional compressor of the same size, the compressor of the present embodiment achieves a greater displacement of the valve flap 253 per given flexure of the suction reed valve 25*a*. Therefore, when the pressure in the compression chamber 24 exceeds the pressure in the suction chamber 5*a*, the opening-closing portion 213 rapidly closes the suction port 23*a*. On the other hand, when the pressure of the compression chamber 24 falls below the pressure of the suction chambers 5*a*, the opening-closing portion 213 rapidly opens the suction port 23*a*. As a result, refrigerant is permitted to smoothly flow through the suction port 23*a*.

Further, in the case of the suction port 23*a*, which extends in the width direction, the distal edge 213*a* of the opening-closing portion 213, which faces the suction port 23*a*, extends in a substantially straight manner and does not conform to the circumference of the compression chamber 24. Therefore, the space 103, through which refrigerant flows, can be formed largely between the distal edge 213*a* and the cylinder bore 1*a*. As a result, the refrigerant that has passed through the suction port 23*a* smoothly flows into the compression chamber via the space 103.

In the case of the suction port 23*a*, which extends in the width direction, the dimension in the longitudinal direction of the valve flap 253, which selectively opens and closes the suction port 23*a*, can be reduced. This reduces deformation of the valve flap 253.

In the compressor of the present embodiment, the width W of the basal portion 252 is set to be greater than the length L in the width direction of the suction port 23*a*. This allows the opening-closing portion 213, which faces the suction port 23*a*, to be reliably supported.

Further, according to the compressor of the present embodiment, when the valve flap 253 starts opening the suction port 23*a*, the pair of stoppers 211, 212 contacts the retainers 111, 112, respectively, and displacement thereof is restricted. The valve flap 253 is therefore held in a state for opening the suction port 23*a*.

The valve flap 253 does not have a stopper like the main stopper in the above described conventional compressor. That is, the valve flap 253 has no stopper that protrudes from the opening-closing portion 213 toward the distal side D1 in the longitudinal direction. Therefore, the refrigerant that has passed through the suction port 23*a* is not blocked by a stopper when passing through the space between the distal edge 213*a* and the cylinder bore 1*a*.

The side edges 252*a*, 252*b* in the width direction are continuous from the stoppers 211, 212 to the basal portion 252 in a manner gradually approaching the suction port 23*a*. Therefore, the spaces 101, 102 for allowing refrigerant to pass can be largely formed between the side edge 252*a* and the cylinder bore 1*a* and between the side edge 252*b* and the cylinder bore 1*a*. Thus, the refrigerant that has passed through the suction port 23*a* is unlikely to be blocked by the side edges 252*a*, 252*b*.

That is, the refrigerant that has passed through the suction port 23*a* are split into three directions, or to the distal side D1 and the sides in the width direction (arrows A, B and C in FIG. 3) before being conducted into the compression chamber 24. This promotes inflow of refrigerant into the compression chamber 24.

The compressor according to the first embodiment therefore significantly reduces the suction resistance.

The compressor of the present embodiment further has recessed grooves 272 and the sealing surfaces 271 on the valve base plate 27. Since each opening-closing portion 213 and the corresponding side edges 252*a*, 252*b* are separated from the bottom surface of a recessed groove 272, the opening-closing portion 213 is easily opened by pressure difference. Since the sealing surface 271 contacts, in a loop area, the back surface 25*r* of the opening-closing portion 213 when the valve is closed, which prevents leakage of refrigerant from the compression chamber 24 to the suction chamber 5*a* via the suction port 23*a*.

Further, the retainers 111 and 112 of the compressor of the present embodiment have different depths. Thus, when the valve flap 253 starts opening the suction port 23*a*, the stopper 211 first contacts the retainer 111, as shown in FIG. 6, so that further displacement thereof is restricted. Next, as shown in FIG. 7, the stopper 212 contacts the retainer 112 so that further displacement thereof is restricted. As a result, as shown in FIG. 8, the valve flap 253 is twisted at the distal side D1 to be held inclined relative to the fixation surface 270, thereby opening the suction port 23*a*. At this time, the contact of the stopper 211 with the retainer 111 reduces rapid movement of the basal portion 252 and the valve flap 253 when these start separating from the fixation surface 270. When the basal portion 252 and the valve flap 253 are further separated from the fixation surface 270, frictional resistance is generated between the stopper 211 and the retainer 111, which contact each other. This effectively reduces vibrations of the basal portion 252 and the valve flap 253. Therefore, the amplitude of the vibrations of the basal portion 252 and the valve flap 253 is reduces. As a result, the compressor is capable of reducing suction pulsation.

Second Embodiment

Figure 9:
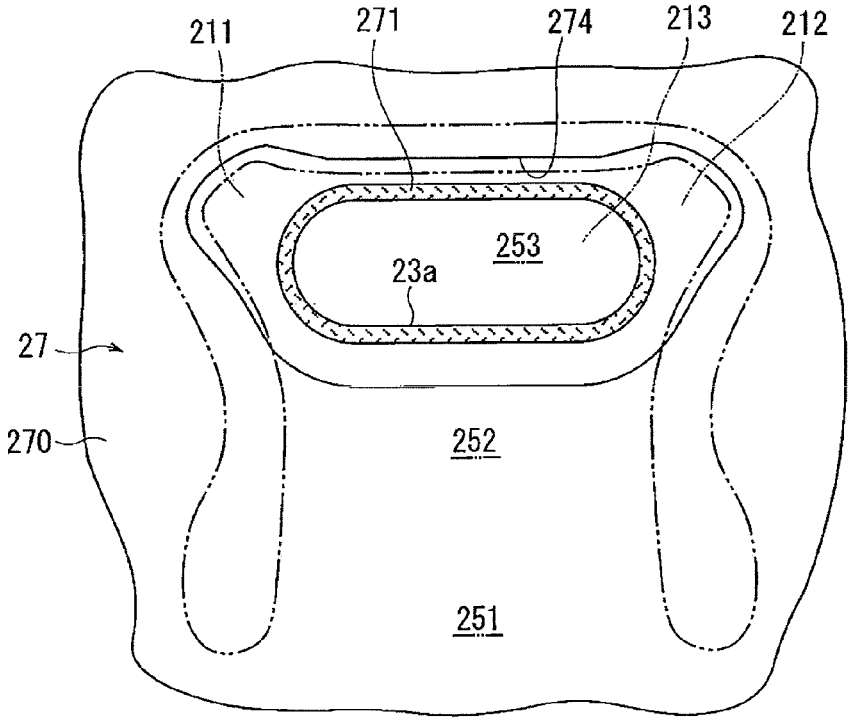
FIG. 9 is an enlarged plan view of a compressor according to a second embodiment, illustrating a valve base plate and a suction reed valve.

A second embodiment of the present embodiment will be described with reference to FIG. 9. FIG. 9 is a plan view illustrating a section of a valve base plate 27 in a solid line and virtually showing a suction valve plate 25 in a broken line in which a long dash alternates with a pair of short dashes.

In the second embodiment, the shape of recessed grooves 274 is different from that of the recessed grooves 272 of the first embodiment. The compressor of the second embodiment has recessed grooves 274. Each recessed groove 274 has ends that bulge by a greater amount toward the distal side D1 than the recessed groove 272 of the first embodiment as shown in FIG. 9. The shape of the ends at the distal end of the recessed groove 274 is substantially similar to the shape of the stoppers 211, 212, but slightly larger than the stoppers 211, 212. The stoppers 211, 212 are separated from the bottom surface of the recessed groove 274. The cross-hatched section is a sealing surface 271, which is the same as the first embodiment. Other configurations are the same as those of the first embodiment.

In the compressor of the present embodiment, since the stoppers 211, 212 are separated from the bottom surface of the recessed groove 274, the opening-closing portion 213 is easily opened by pressure difference. Also, the compressor is unlikely to generate suction pulsations.

Therefore, the compressor of the second embodiment reduces suction resistance by a greater amount. The compressor also achieves the same advantages as the first embodiment.

Third Embodiment

Figure 10A:
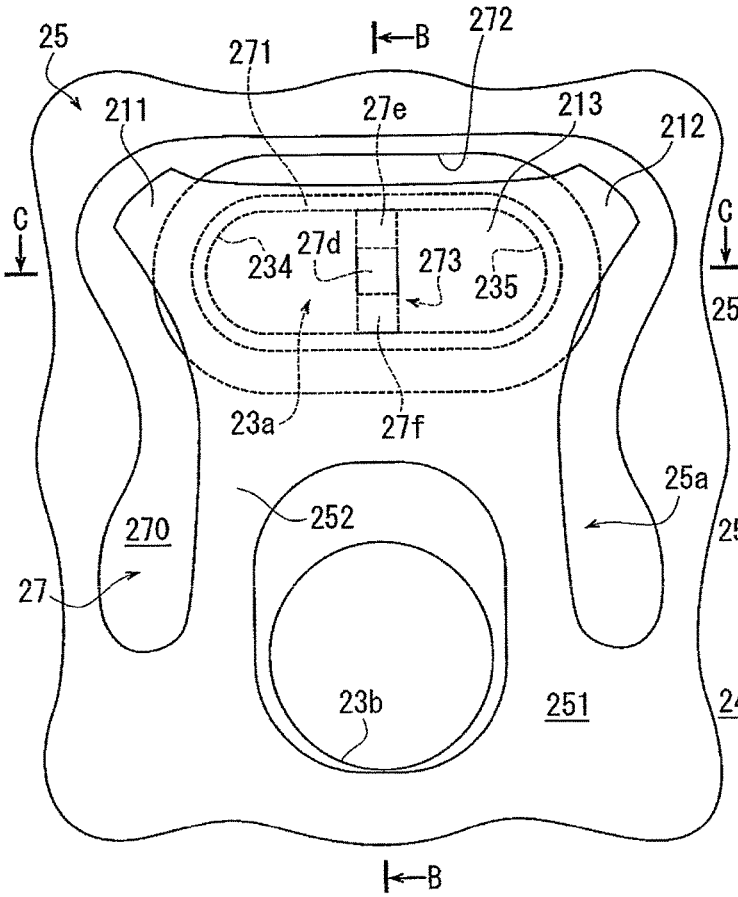
FIG. 10A is an enlarged plan view of a compressor according to a third embodiment, illustrating a valve base plate and a suction reed valve.
Figure 10B:
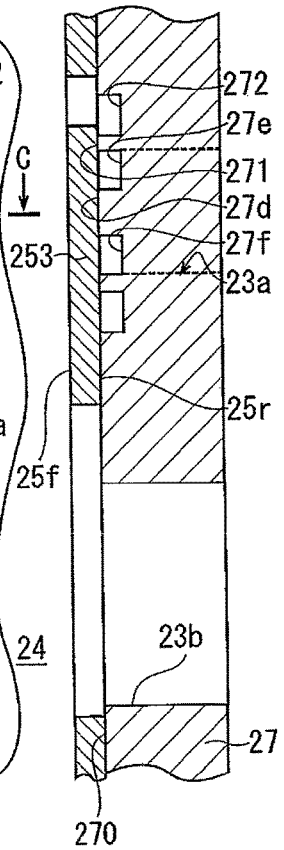
FIG. 10B is a cross-sectional view taken along line B-B in FIG. 10A.
Figure 10C:
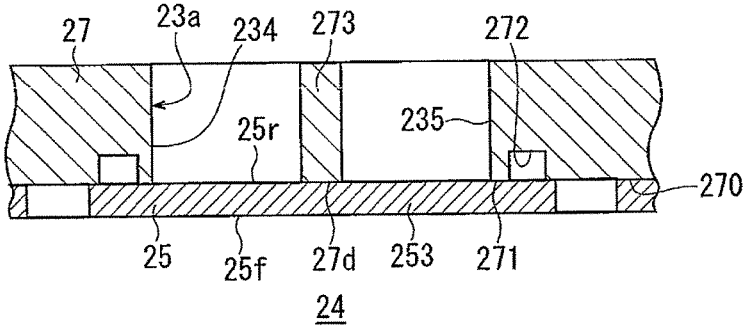
FIG. 10C is a cross-sectional view taken along line C-C in FIG. 10A.

In a compressor according to a third embodiment, the valve base plate 27 has extension portions 273, each of which extends in the longitudinal direction to divide a suction port 23*a* into two as shown in FIG. 10. The extension portion 273 divides the suction port 23*a* into right and left halves in the direction perpendicular to the longitudinal direction. The suction port 23*a* is divided into two bullet-shaped port sections 234, 235 by the extension portion 273. When the valve base plate 27 is seen in a plan view, the suction port 23*a* has an oblong shape with the port sections 234, 235.

A support surface 27*d* is formed in the center of a surface of the extension portion 273 that faces the valve flap 253. The support surface 27*d* is also flush with the fixation surface 270. The support surface 27*d* is contactable with the back surface 25*r* in the central region of the opening-closing portion 213. Communicating grooves 27*e*, 27*f* are formed on the extension portion 273 at positions forward of and rearward of the support surface 27*d*. The communicating grooves 27*e*, 27*f* are recessed in relation to the fixation surface 270. Thus, when the valve flap 253 is in the closed position, the communicating grooves 27*e*, 27*f* connect the port sections 234, 235 with each other. The other configurations are the same as those of the first embodiment.

Figure 11:
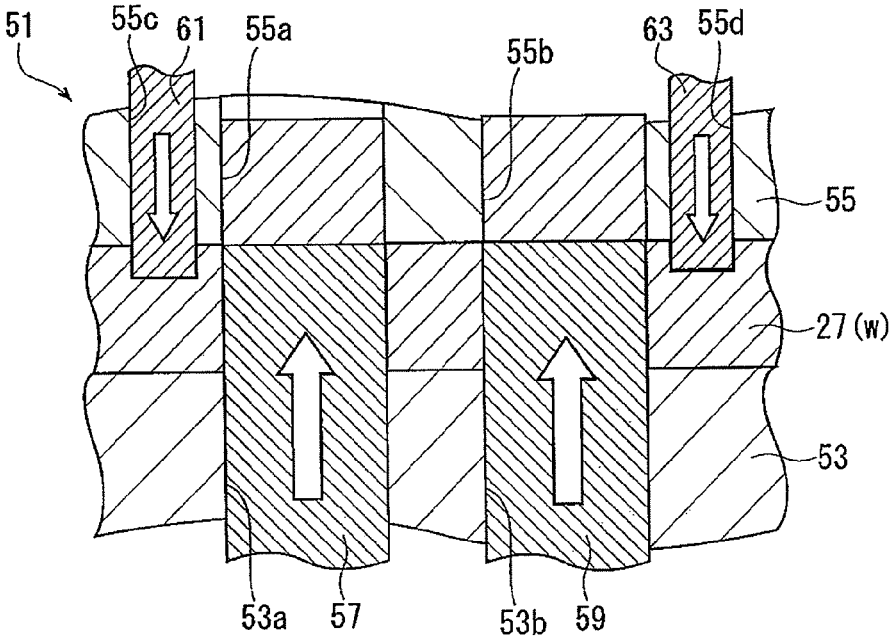
FIG. 11 is a schematic cross-sectional view of the compressor of the second embodiment, illustrating a manufacturing step of the valve base plate.

The valve base plate 27 is formed using a die 51 shown in FIG. 11. The die 51 has a lower die portion 53 and an upper die portion 55. A workpiece w, from which the valve base plate 27 is formed, is clamped between the lower die portion 53 and the upper die portion 55. The lower die portion 53 has punch holes 53*a*, 53*b* at positions corresponding to the port sections 234, 235. The punch holes 53*a*, 53*b* extend through the lower die portion 53 in the vertical direction. Punches 57, 59 are respectively received in the punch holes 53*a*, 53*b* to be movable in the vertical direction.

The upper die portion 55 has ejection holes 55*a*, 55*b* corresponding to the punch holes 53*a*, 53*b*. The ejection holes 55*a*, 55*b* extend through the upper die portion 55 in the vertical direction. Also, punch holes 55*c*, 55*d* are formed in the upper die portion 55 at positions corresponding to the recessed grooves 272 and the communicating grooves 27*e*, 27*f* to extend through the upper die portion 55 in the vertical direction. Punches 61, 63 are respectively received in the punch holes 55*c*, 55*d* to be movable in the vertical direction.

To form the valve base plate 27 from the workpiece w, the workpiece w is placed between the lower die portion 53 and the upper die portion 55. Then, the punches 57, 59 are raised from below and the punches 61, 63 are lowered from above. As a result, the port sections 234, 235 are formed through punching and the recessed grooves 272 and the communicating grooves 27*e*, 27*f* are formed through crushing. Afterwards, surface polishing is performed to complete the valve base plate 27. This reduces the manufacturing costs compared to a cutting process.

When each suction reed valve 25*a* closes in this compressor and the central region of the opening-closing portion 213 acts to move toward the valve base plate 27 due to an inertial force and a pressure difference, the support surface 27*d*, which is formed on the valve base plate 27 to be flush with the fixation surface 270, contacts the back surface 25*r* of the central region of the opening-closing portion 213. Thus, the central region of the opening-closing portion 213 is not significantly flexed into the suction port 23*a*. Therefore, the valve flap 253 becomes less prone to fatigue failure. Also, the compressor is unlikely to generate suction pulsations.

The communicating grooves 27*e*, 27*f*, which communicate with the suction port 23*a* when the valve is closed, are formed in the surface of the extension portion 273 that faces the valve flap 253. Thus, a force causing tight contact does not easily act on the back surface 25*r* of the valve flap 253. Instead, the pressure in the suction port 23*a* acts on the back surface of the valve flap 253. This further reduces the suction resistance, and power loss is further reliably reduced.

Therefore, the compressor of the third embodiment reduces suction resistance by a greater amount. The compressor also achieves the same advantages as the first embodiment.

Fourth Embodiment

Figure 12:
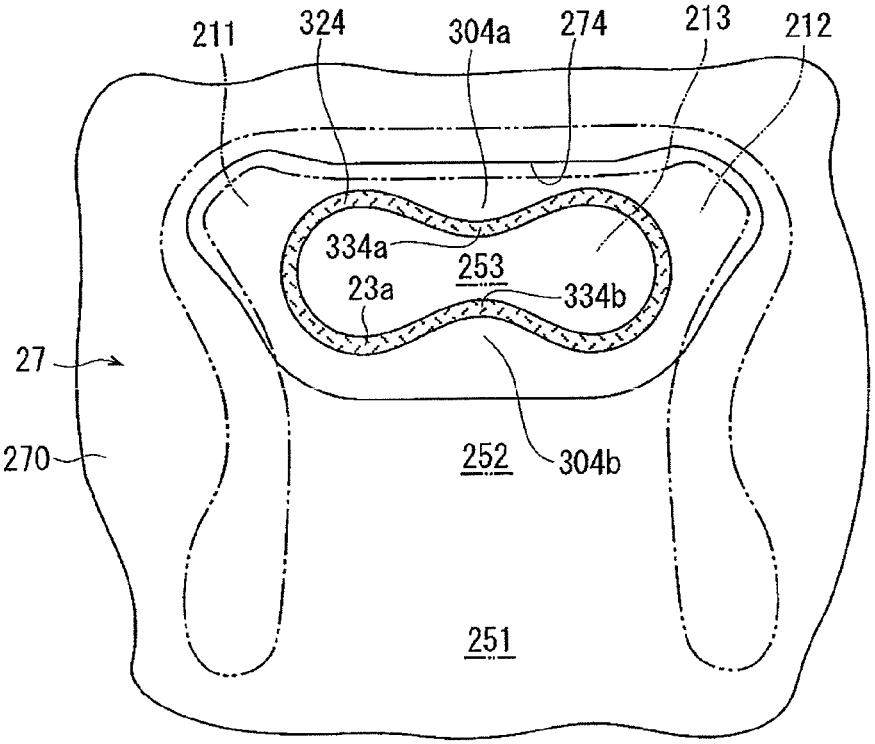
FIG. 12 is an enlarged plan view of a compressor according to a fourth embodiment, illustrating a valve base plate and a suction reed valve.

A compressor of a fourth embodiment has recessed grooves 274. Each recessed groove 274 has ends that bulge by a greater amount toward the distal side D1 than the recessed groove 272 of the first embodiment as shown in FIG. 12. The valve base plate 27 has pairs of extension portions 304*a*, 304*b*, each of which extends in the longitudinal direction of a suction port 23*a*. The extension portions 304*a*, 304*b* narrows the clearance between the opposite sides at the middle position in the suction port 23*a*. The extension portion 304*a* protrudes from the side closer to the distal side D1 in the longitudinal direction toward the basal portion 252, while the extension portion 304*b* protrudes from the side closer to the basal portion 252 in the longitudinal direction toward the distal side D1. The extension portions 304*a*, 304*b* do not divide the suction port 23*a* into right and left halves in the direction perpendicular to the longitudinal direction. When the valve base plate 27 is seen in a plan view, the suction port 23*a* has an oblong shape with a constriction in the middle with the extension portions 304*a*, 304*b*. The sealing surface 324, which is indicated by cross-hatching, has the same shape as the suction port 23*a*. Parts of the sealing surface 324 at which the extension portions 304*a*, 304*b* are located are defined as support surfaces 334*a*, 334*b*, which contact the back surface 25*r* of the central region of the opening-closing portion 213. The other configurations are the same as those of the first embodiment.

This compressor achieves the advantages of the second and third embodiments.

Fifth Embodiment

Figure 13:
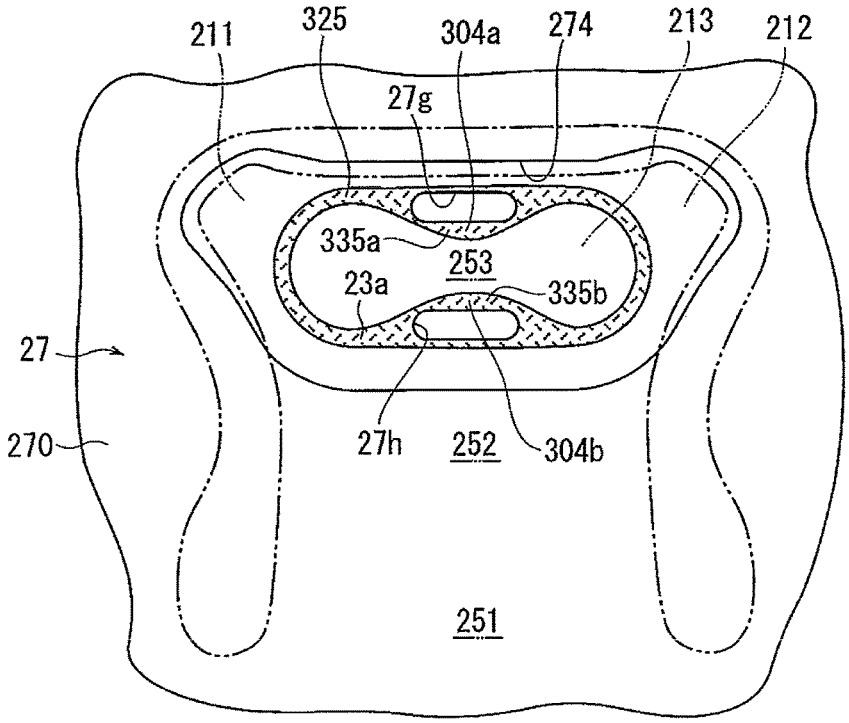
FIG. 13 is an enlarged plan view of a compressor according to a fifth embodiment, illustrating a valve base plate and a suction reed valve.

A compressor according to a fifth embodiment has recessed grooves 274 as shown in FIG. 13, which are similar to those in the second embodiment. The valve base plate 27 also includes pairs of extension portions 304*a*, 304*b* as in the fourth embodiment. Recesses 27*g*, 27*h* are formed in surfaces of the extension portions 304*a*, 304*b* that face the valve flap 253. A sealing surface 325 is formed between the recessed groove 274 and the suction port 23*a*. The recesses 27*g*, 27*h* are surrounded by the sealing surface 325, and are not connected to the suction port 23*a* when the valve is closed. Parts of the sealing surface 325 at which the extension portions 304*a*, 304*b* are located are defined as support surfaces 335*a*, 335*b*, which contact the back surface 25*r* of the central region of the opening-closing portion 213. The other configurations are the same as those of the second and fourth embodiments.

This compressor achieves the advantages of the second and fourth embodiments. Particularly, the recesses 27*g*, 27*h* hinders a tight contact causing force from acting on the back surface 25*r* of the valve flap 253. Thus, the suction resistance can be further reduced, and power loss is further reliably reduced.

Sixth Embodiment

Figure 14:
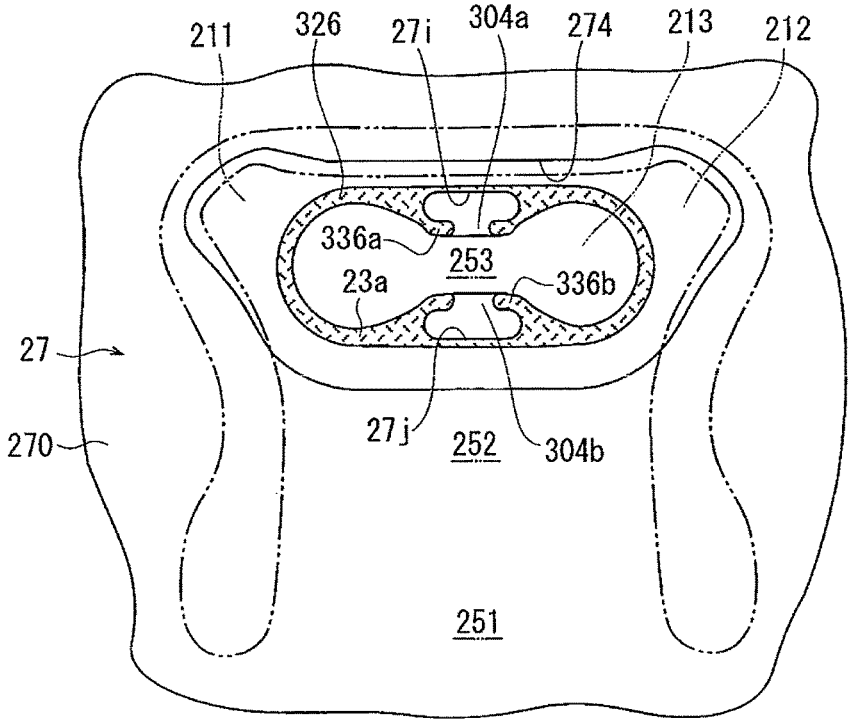
FIG. 14 is an enlarged plan view of a compressor according to a sixth embodiment, illustrating a valve base plate and a suction reed valve.

A compressor according to a sixth embodiment has recessed grooves 274 as shown in FIG. 14, which are similar to those in the second embodiment. The valve base plate 27 also includes pairs of extension portions 304*a*, 304*b* as in the fourth embodiment. Communicating grooves 27*i*, 27*j* are formed in areas of the extension portions 304*a*, 304*b* that face the valve flap 253. A sealing surface 326 is formed between the recessed groove 274 and the suction port 23*a*. The communicating grooves 27*i*, 27*j* open to the suction port 23*a* from the sealing surface 326 and communicate with the suction port 23*a* when the valve is closed. Parts of the sealing surface 326 at which the extension portions 304*a*, 304*b* are located are defined as support surfaces 336*a*, 336*b*, which contact the back surface 25*r* of the central region of the opening-closing portion 213. The other configurations are the same as those of the second embodiment.

This compressor achieves the advantages of the second and fourth embodiments. Particularly, in this compressor, the communicating grooves 27*i*, 27*j* prevent a tight contact causing force from easily acting on the back surface 25*r* of the valve flap 253. Instead, the pressure in the suction port 23*a* acts on the back surface 25*r* of the valve flap 253. Thus, the suction resistance can be further reduced, and power loss is further reliably reduced.

Seventh Embodiment

Figure 15:
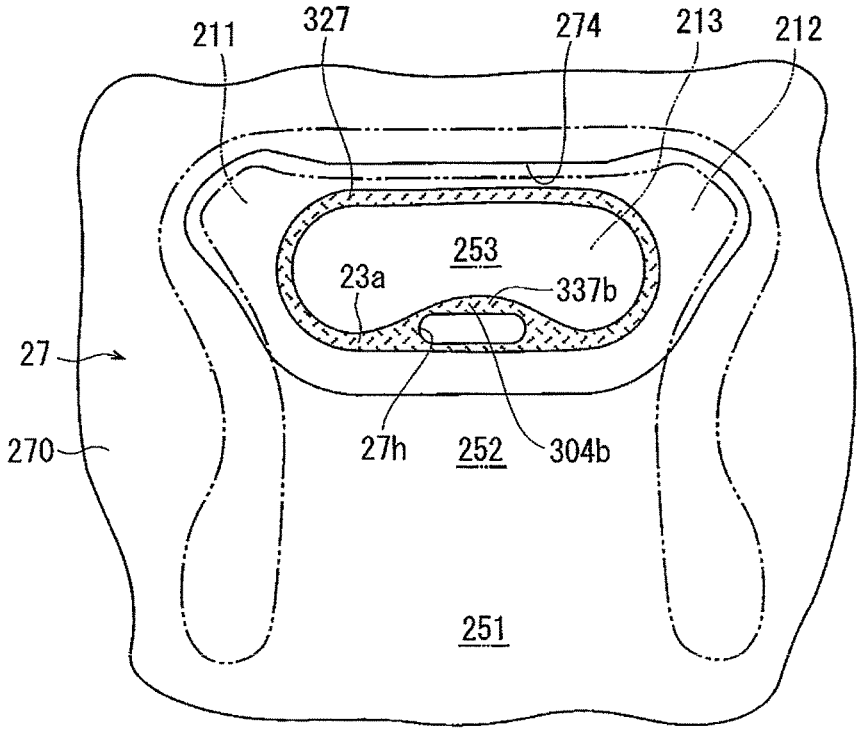
FIG. 15 is an enlarged plan view of a compressor according to a seventh embodiment, illustrating a valve base plate and a suction reed valve.

A compressor according to a seventh embodiment has recessed grooves 274 as shown in FIG. 15, which are similar to those in the second embodiment. The valve base plate 27 also includes extension portions 304*b* as in the fourth embodiment. The extension portion 304*b* protrudes only from the side closer to the basal portion 252 in the longitudinal direction toward the distal side D1. A recess 27*h* is formed in an area of the extension portion 304*b* that faces the valve flap 253. A sealing surface 327 is formed between the recessed groove 274 and the suction port 23*a*. When the valve base plate 27 is seen in a plan view, the suction port 23*a* has an eyeglass-like shape with the extension portion 304*b*. The recess 27*h* is surrounded by the sealing surface 327, and is not connected to the suction port 23*a* when the valve is closed. A part of the sealing surface 327 at which the extension portion 304*b* is located is defined as a support surface 337*b*, which contacts the back surface 25*r* of the central region of the opening-closing portion 213. The other configurations are the same as those of the second embodiment.

This compressor achieves the advantages of the second embodiment. Particularly, in this compressor, the instant the suction reed valve 25*b* separates from the valve base plate 27 at the basal portion 252 and the valve flap 253 opens the suction port 23*a*, refrigerant is readily drawn into the compression chamber 24 through the space at the distal side D1 of the suction port 23*a* in the longitudinal direction without being blocked by the extension portion 304*b*. This reduces the suction resistance, thereby more reliably reducing power loss.

Eighth Embodiment

Figure 16:
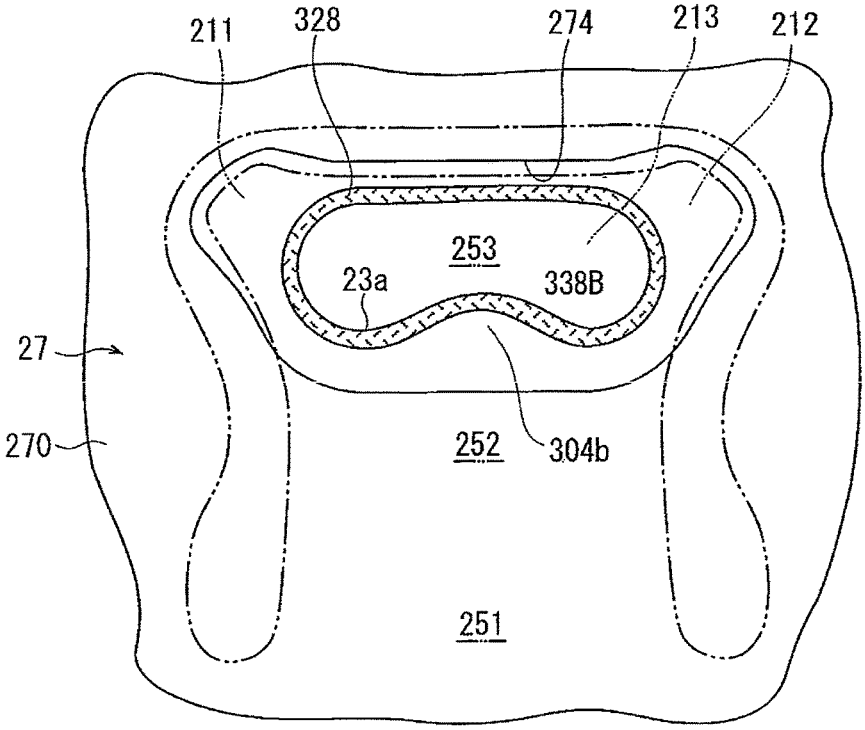
FIG. 16 is an enlarged plan view of a compressor according to an eighth embodiment, illustrating a valve base plate and a suction reed valve.

A compressor of an eight embodiment has recessed grooves 274. Each recessed groove 274 has ends that bulge by a greater amount toward the distal side D1 than the recessed groove 272 of the first embodiment as shown in FIG. 16. The valve base plate 27 also includes extension portions 304*b* as in the fourth embodiment. The extension portion 304*b* protrudes only from the side closer to the basal portion 252 in the longitudinal direction toward the distal side D1. When the valve base plate 27 is seen in a plan view, the suction port 23*a* has an eyeglass-like shape with the extension portion 304*b*. The sealing surface 328, which is indicated by cross-hatching, has the same shape as the suction port 23*a*. A part of the sealing surface 328 at which the extension portion 304*b* is located is defined as a support surface 338*b*, which contacts the back surface 25*r* of the central region of the opening-closing portion 213. The other configurations are the same as those of the second and fourth embodiments.

This compressor achieves the advantages of the second and fourth embodiments.

Ninth Embodiment

Figure 17:
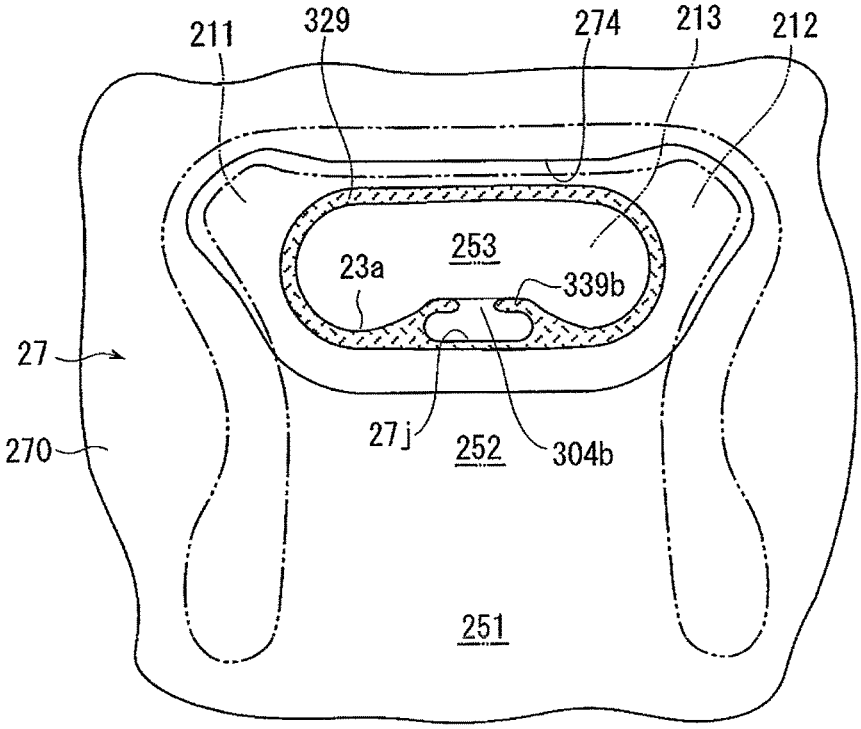
FIG. 17 is an enlarged plan view of a compressor according to a ninth embodiment, illustrating a valve base plate and a suction reed valve.

A compressor according to a ninth embodiment has recessed grooves 274 as shown in FIG. 17, which are similar to those in the second embodiment. The valve base plate 27 also includes extension portions 304*b* as in the fourth embodiment. The extension portion 304*b* protrudes only from the side closer to the basal portion 252 in the longitudinal direction toward the distal side D1. A communicating groove 27*j* is formed in an area of the extension portion 304*b* that faces the valve flap 253. A sealing surface 327 is formed between the recessed groove 274 and the suction port 23*a*. When the valve base plate 27 is seen in a plan view, the suction port 23*a* has an eyeglass-like shape with the extension portion 304*b*. The communicating groove 27*j* opens to the suction port 23*a* from the sealing surface 329 and communicates with the suction port 23*a* when the valve is closed. A part of the sealing surface 329 at which the extension portion 304*b* is located is defined as a support surface 339*b*, which contacts the back surface 25*r* of the central region of the opening-closing portion 213. The other configurations are the same as those of the second and fourth embodiments.

This compressor achieves the advantages of the second and fourth embodiments.

Tenth Embodiment

Figure 18:
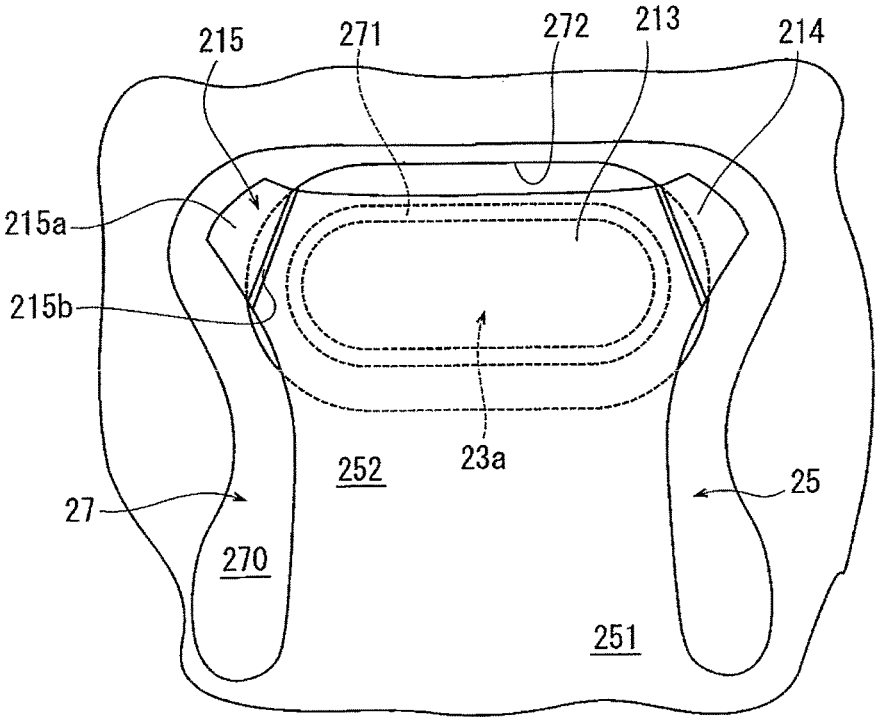
FIG. 18 is an enlarged plan view of a compressor according to a tenth embodiment, illustrating a valve base plate and a suction reed valve.
Figure 19:
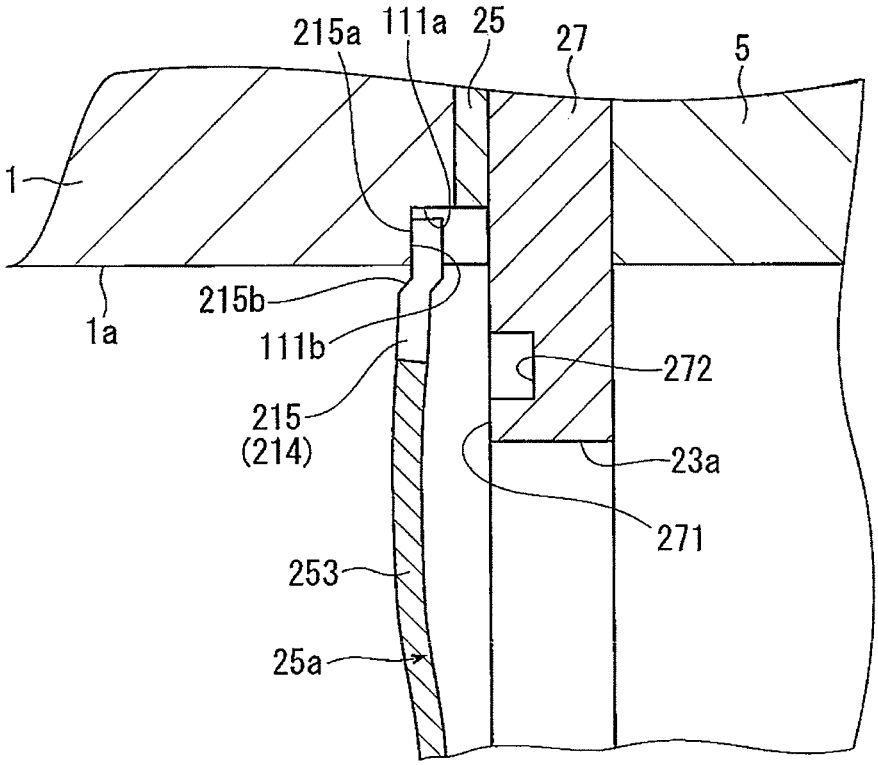
FIG. 19 is an enlarged longitudinal cross-sectional view of the compressor of the tenth embodiment.

As shown in FIGS. 18 and 19, each stopper 215 of a compressor according to a tenth embodiment has a bent surface 215*b* and a flat surface 215*a*. The flat surface 215*a* contacts the contact surface 111*b* of the corresponding retainer 111, that is, makes surface contact with the retainer 111. Each stopper 214 is formed in the same manner as the stoppers 215. The other configurations are the same as those of the first embodiment.

In this compressor, the stoppers 215, 214 and the retainers 111, 112 are unlikely to be damaged and therefore have an improved durability. The compressor also achieves the same advantages as the first embodiment.

Although only the first to tenth embodiments of the present invention have been described so far, the present invention is not limited to the first to tenth embodiments, but may be modified as necessary without departing from the scope of the invention.

The invention claimed is:

1. A compressor, comprising:

a housing;

a compression chamber defined in the housing, wherein refrigerant is compressed in the compression chamber;

a suction chamber defined in the housing, wherein the refrigerant is drawn into the compression chamber through the suction chamber;

a valve base plate located between the compression chamber and the suction chamber;

a suction valve plate provided over the valve base plate;

a plurality of suction ports formed in the valve base plate to extend through the valve base plate, wherein the plurality of suction ports is capable of connecting the compression chamber and the suction chamber with each other; and a plurality of suction reed valves for selectively opening and closing the plurality of suction ports, the plurality of suction reed valves being defined by apertures penetrating the suction valve plate to form spaces in the suction valve plate and define outer profiles of the plurality of suction reed valves, wherein each of the plurality of suction reed valves has an elongated shape with a distal end and is elastically deformable, each of the suction reed valves including: a fixation portion fixed to the valve base plate, a basal portion that extends from the fixation portion in the longitudinal direction of the suction reed valve and is separable from the valve base plate, and a valve flap that extends from the basal portion toward the distal end in the longitudinal direction of the suction reed valve to selectively open and close the suction port, the valve base plate has a fixation surface that faces the compression chamber, wherein the fixation portion is fixed to the fixation surface, a corresponding one of the suction ports having a shape elongated in a width direction, which is orthogonal to the longitudinal direction of a corresponding one of the suction reed valves, the width of a corresponding one of the basal portions is set to be greater than the measurement of the corresponding one of the suction ports in the width direction, the valve flap includes an opening-closing portion that faces the suction port, a pair of stoppers projecting from the opening-closing portion at both ends in the width direction of the corresponding one of the suction ports, wherein the stoppers protrude in opposite directions from each other, and an outermost side of each of the pair of stoppers is arcuate, and a pair of side edges, which encompasses the outermost side of each of the pair of stoppers, the pair of side edges extending continuously from the outermost side of the pair of stoppers to the corresponding one of the basal portions, wherein the pair of side edges approach each other in a direction from the distal end of the corresponding one of the suction reed valves toward the corresponding one of the basal portions so as to define a minimum width of the corresponding one of the basal portions, wherein the outermost side of each of the pair of stoppers entirely diverge from each other in a direction towards a free end of the valve flap to define a maximum width of the valve flap, the spaces being provided so as to extend along each of the pair of side edges, the housing has a pair of retainers, wherein each stopper contacts one of the retainers, and wherein refrigerant in the suction chamber is configured to be drawn into the compression chamber through the spaces.

2. The compressor according to claim 1, wherein the stoppers are each formed to make surface contact with the corresponding retainer.

3. The compressor according to claim 1, wherein the depths of the retainers are different from each other.

4. The compressor according to claim 1, wherein each of the pair of side edges comprises a continuous curve that extends from a minimum width of the corresponding one of the basal portions to a maximum width of the valve flap.

5. The compressor according to claim 1, wherein a distance between the distal end of the suction reed valve and an outer periphery of the suction port is less than a distance between the outermost side of each of the pair of stoppers and the outer periphery of the suction port.

6. The compressor according to claim 1, wherein the valve base plate includes:

a loop-shaped recessed groove that is formed in the fixation surface and encompasses the corresponding one of the suction ports; and a sealing surface formed inside the region encompassed by the recessed groove, wherein the sealing surface is flush with the fixation surface and is contactable in a loop area with the opening-closing portion in a region about the suction port.

7. The compressor according to claim 6, wherein the side edges are separated from the bottom surface of the recessed groove.

8. The compressor according to claim 6, wherein the stoppers are separated from the bottom surface of the recessed groove.

9. The compressor according to claim 1, wherein the valve base plate has a support surface that is flush with the fixation surface and contactable with a central region of the opening-closing portion.

10. The compressor according to claim 9, wherein the valve base plate has an extension portion that extends in a manner dividing the suction port in two in the width direction, and the support surface is formed on the extension portion.

11. The compressor according to claim 10, wherein the extension portion extends in the longitudinal direction of the corresponding one of the suction reed valves only from a side of the corresponding one of the suction ports that is nearest the corresponding one of the basal portions toward a side of the corresponding one of the suction ports that is nearest the distal end of the corresponding one of the suction reed valves.

12. The compressor according to claim 10, wherein a communicating groove is recessed in a surface of the extension portion that faces the valve flap, and the communicating groove communicates with the corresponding one of the suction ports when the corresponding one of the suction ports is closed.

13. The compressor according to claim 12, wherein the corresponding one of the suction ports is formed by punching, and the recessed groove and the communicating groove are formed by crushing.

14. The compressor according to claim 10, wherein a recess is recessed in a surface of the extension portion that faces the valve flap, and the recess is disconnected from the corresponding one of the suction ports when the corresponding one of the suction ports is closed.

15. The compressor according to claim 14, wherein the corresponding one of the suction ports is formed by punching, and the recessed groove and the recess are formed by crushing.

* * * * *